US008864043B2

(12) United States Patent
Hanke et al.

(10) Patent No.: US 8,864,043 B2
(45) Date of Patent: Oct. 21, 2014

(54) RAIL FASTENING SYSTEM

(75) Inventors: Dennis Hanke, Algonquin, IL (US); Dean T. Wickman, Quinnesec, MI (US)

(73) Assignee: Rail Construction Equipment Company, Rockford, IL (US)

( * ) Notice: Subject to any disclaimer, the term of this patent is extended or adjusted under 35 U.S.C. 154(b) by 310 days.

(21) Appl. No.: 13/399,653

(22) Filed: Feb. 17, 2012

(65) Prior Publication Data

US 2012/0211571 A1 Aug. 23, 2012

Related U.S. Application Data

(60) Provisional application No. 61/443,885, filed on Feb. 17, 2011.

(51) Int. Cl.
*E01B 9/00* (2006.01)
*E01B 9/30* (2006.01)

(52) U.S. Cl.
CPC ..... *E01B 9/30* (2013.01)
USPC ..... 238/355; 238/327 R; 238/315

(58) Field of Classification Search
CPC ..... E01B 9/00; E01B 9/28; E01B 9/30; E01B 9/60; E01B 9/46; E01B 9/58; E01B 9/48; E01B 3/36; E01B 13/00; E01B 13/02
USPC ..... 238/315, 338, 343, 349, 350, 351, 355, 238/356, 357, 361
See application file for complete search history.

(56) References Cited

U.S. PATENT DOCUMENTS

| | | | | | |
|---|---|---|---|---|---|
| 2,299,354 | A | * | 10/1942 | Spencer | 238/343 |
| 3,616,999 | A | * | 11/1971 | Ruble | 238/95 |
| 3,830,427 | A | * | 8/1974 | Polidori | 238/14.14 |
| 4,572,432 | A | * | 2/1986 | Moehren | 238/327 R |
| 4,874,128 | A | * | 10/1989 | Owen | 238/355 |
| 5,165,599 | A | * | 11/1992 | Owen et al. | 238/355 |
| 5,288,016 | A | * | 2/1994 | Owen | 238/355 |
| 5,494,212 | A | * | 2/1996 | Owen | 238/265 |
| 7,374,110 | B2 | * | 5/2008 | Walsh | 238/351 |
| 7,530,502 | B2 | * | 5/2009 | Sherriff et al. | 238/338 |
| 7,984,862 | B2 | * | 7/2011 | Henderson et al. | 238/315 |
| 7,992,797 | B2 | * | 8/2011 | Reichle | 238/316 |
| 2008/0257973 | A1 | * | 10/2008 | Reichle | 238/351 |

* cited by examiner

*Primary Examiner* — Jason C Smith
(74) *Attorney, Agent, or Firm* — Reinhart Boerner Van Deuren P.C.

(57) ABSTRACT

A rail fastening system is provided. The rail fastening system includes a fastener including a baseplate and at least one of clamp. The at least one clamp mounts with the baseplate and extends under a rail of a railroad to abut against a flange of the rail opposite a flange adjacent to the baseplate. Certain embodiments of the fastener include adjustment teeth to finely adjust the positioning of the clamps relative to the baseplate. Certain other embodiments of the fastener include slotted clamps that receive a baseplate.

10 Claims, 6 Drawing Sheets

RAIL FASTENING SYSTEM

CROSS-REFERENCE TO RELATED PATENT APPLICATIONS

This patent application claims the benefit of U.S. Provisional Application No. 61/443,885, filed Feb. 17, 2011, the entire teachings and disclosure of which are incorporated herein by reference thereto.

FIELD OF THE INVENTION

This invention generally relates to fastening systems for the rails of a railroad, and more specifically to temporary fastening systems used to temporarily affix a rail to a concrete railroad tie when a tower of the concrete railroad tie has been damaged or destroyed.

BACKGROUND OF THE INVENTION

Concrete railroad ties are growing in popularity as a more robust alternative to traditional wooden railroad ties. One well-known difference between these two types of ties is the way in which the rails of a railroad are fastened to the ties. Wooden ties use a traditional spike and baseplate arrangement, wherein a baseplate is positioned on a top surface of the wooden tie, and the spike is driven through the baseplate into the tie. A top head of the spike engages a portion of the rail and holds it against the baseplate.

Concrete ties, on the other hand, use a pair of metal fasteners positioned on either side of each rail such that a single concrete railroad tie will incorporate four fasteners in total (two for each of the two rails). These fasteners generally each have two primary components in the form of a tower and a clip. The tower is rooted or cast into the concrete railroad tie such that an upper portion of the tower extends from a top surface of the railroad tie. The clip connects to this upper portion as well as a portion of the rail to bias the rail against the top surface of the railroad tie and hold the rail in place.

Because of the permanent nature of the mounting of towers relative to the concrete tie, an entire tie can be deemed unserviceable in the event a single tower is destroyed or otherwise damaged. Put another way, in the event a tower is damaged, the entire concrete tie must be removed and replaced with a new concrete tie.

In the unfortunate occurrence of train derailments, it has been found that multiple fasteners, i.e. clips and the upper portions of towers, can be destroyed in a single derailment event by the wheels of the derailed train. Unfortunately, when one or more fasteners of a concrete tie are destroyed or otherwise compromised by a derailment, there is a risk that the rail or rails will dislodge from the concrete tie, and cause a later derailment in the event another train attempts to use that particular railroad line.

As a result of the aforementioned risk, a railroad is typically shut down until the damaged concrete ties can be replaced. Concrete tie replacement requires multiple pieces of heavy equipment, so a shut down can last an undesirable length of time as the heavy equipment is procured and brought out to the derailment site, and the ties are replaced. This extended shut down period can lead to late deliveries which may translate into monetary damages, heightened shipping costs, and congestion on other railroad lines as trains are rerouted.

Due to the above noted problems, there is a need in the art for a temporary fastening system that will allow concrete ties that have damaged towers to remain in service until the damaged ties can be replaced.

The invention provides such a rail fastening system. These and other advantages of the invention, as well as additional inventive features, will be apparent from the description of the invention provided herein.

BRIEF SUMMARY OF THE INVENTION

In one aspect, embodiments of the present invention provide a rail fastening system for securing a rail to a railroad tie. The railroad tie includes a first connector on a first side of the rail and a second connector on a second side of the rail. The first and second connectors interpose the rail and are operable for securing the rail to the railroad tie when each of the first and second connectors are in a serviceable condition. The rail fastening system according to this aspect includes a baseplate configured for abutment with the first connector. At least one clamp is coupled to the baseplate on the first side of the rail and includes a hook portion for contacting the rail on the second side of the rail.

In certain embodiments, the at least one clamp includes a first clamp and a second clamp. The first and second clamps are coupled to the baseplate at opposite ends of the baseplate such that the first and second connectors are interposed between the first and second clamps.

In certain embodiments, the hook portion includes a relief section for receipt of a portion of the rail. The relief section is generally circular, such that an end of a flange section of the rail is out of contact with the hook portion when disposed within the relief section.

In certain embodiments, the hook portion includes a top and a bottom abutment surface. The top abutment surface is arranged to contact an upper surface of the flange section interior of the end of the flange section. The bottom abutment surface is arranged to contact an underside of the rail.

In certain embodiments, the at least one clamp includes a handle portion extending away from the hook portion such that the handle portion is entirely disposed on the first side of the rail when the at least one clamp is coupled to the baseplate. In certain embodiments, the handle portion includes a plurality of abutments on an underside thereof for adjustably coupling the at least one clamp to the baseplate. In certain embodiments, the baseplate includes at least one slot for receiving a handle portion such that one of the plurality of abutments abuts a neck portion of the baseplate situated in the slot. In certain other embodiments, the baseplate includes at least one groove for receiving a handle portion such that one of the plurality of abutments abuts the at least one groove.

In certain other embodiments, the handle portion includes a slot therethrough for receipt of the baseplate. In such a slotted embodiment, the baseplate is generally T-shaped, and includes an abutment section formed at an end thereof. The abutment section has a first width that is greater than a second width of the slot such that the abutment section cannot pass through the slot.

In such an embodiment, the baseplate includes a blade section formed at an end thereof opposite the abutment section. The blade section has a reduced thickness relative to the remainder of the baseplate. The baseplate includes an aperture therethrough for receipt of a pin. The pin is a slideably received within the aperture to prevent removal of the baseplate through the slot formed in the handle portion.

In another aspect, a rail fastening system for securing a rail to a railroad tie is provided. The railroad tie includes a first connector on a first side of the rail and a second connector on a second side of the rail. The first and second connectors interpose the rail and are operable for securing the rail to the railroad tie when each of the first and second connectors are in a serviceable condition. The rail fastening system according to this aspect includes a baseplate configured for abutment with the first connector. The rail fastening system also includes at least one clamp including a hook portion for receiving a portion of the rail. The at least one clamp has a mounted position in which the at least one clamp is coupled to the baseplate. The location of the at least one clamp relative to the baseplate in the mounted position is adjustable.

In yet another aspect, a method for securing a rail to a railroad tie with a rail fastening system is provided. The railroad tie includes a first connector at a first side of the rail and a second connector on a second side of the rail. The first and second connectors interpose the rail and are operable for securing the rail to the railroad tie when each of the first and second connectors are in a serviceable condition. The method according to this aspect includes aligning a baseplate on the first side of the rail such that the baseplate is adjacent to the first connector. The method also includes coupling at least one clamp to the baseplate such that the at least one clamp extends underneath the rail and contacts the rail on the second side.

In certain embodiments, coupling the at least one clamp includes coupling a first and second clamp such that the first and second connectors are interposed between the first and second clamps.

In certain other embodiments, coupling the at least one clamp includes placing an abutment of the at least one clamp into abutted contact with the baseplate.

In certain other embodiments, coupling the at least one clamp includes sliding the baseplate through a slot formed in the at least one clamp.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
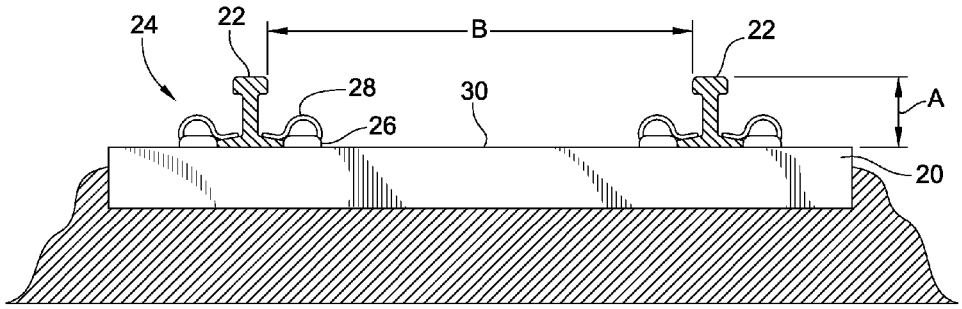
FIG. 1 is a front view of a concrete railroad tie and associated fasteners for affixing a pair of rails of a railroad thereto.

Turning now to the drawings, there is illustrated in FIG. 1 a typical configuration of a concrete railroad tie 20 (hereinafter "tie") with a pair of rails 22 of a railroad mounted thereto via a plurality of connectors 24. Each connector 24 includes a tower 26 and a clip 28. Each rail 22 is positioned between a pair of towers 26 with clips 28 fixing the position of the rail 22 between the towers 26. Indeed, a first one of the connectors 24 is positioned on a first side of the rail 22, while a second one of the connectors 24 is positioned on a second side of the rail 22. As a result, the overall height of the rails 22 taken from the top surface 30 of the tie 20 is generally controlled and illustrated as dimension A. Similarly, the distance between the rails 22 (i.e. the gauge distance) is also generally controlled by way of the connectors 24 and denoted as dimension B.

It will be readily appreciated that in a conventional railroad employing multiple ties 20, each tie 20 will include its own set of connectors 24 to generally maintain the dimensions A and B illustrated. It will also be readily appreciated by those skilled in the art that the particular towers 26 and clips 28 illustrated are one of many conventional designs. It will be recognized from the following description that the type of tower 26 or clip 28 is not limiting in any way on the employment of the various embodiments of the instant invention.

Figure 2:
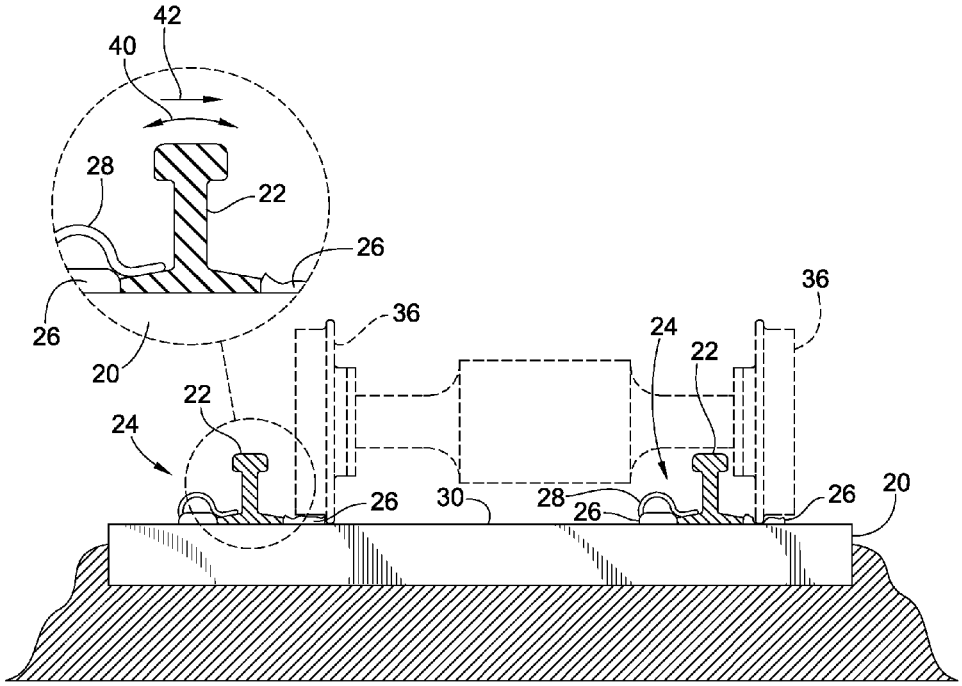
FIG. 2 is a front view of the concrete railroad tie of FIG. 1, with multiple damaged fasteners.

Turning now to FIG. 2, a pair of exemplary rail wheels 36 are illustrated in a derailed condition. In this condition, it has been observed that the rail wheels 36 have a tendency to destroy two of the four connectors 24 of the tie 20. In the illustrated embodiment, the rightmost connector 24 of each of the pair of connectors 24 has been destroyed as a result of collision by the rail wheels 36. However, the leftmost connectors 24 of each of the pair of connectors 24 could also be destroyed if the rail wheels 36 derail in a direction opposite that shown in FIG. 2, (i.e. to the other side of the rails 22), and the teachings of the present invention would apply equally in such a scenario. It will also be recognized from the following that the teachings of the invention disclosed herein may be equally employed in other contexts other than derailment damage events, when a single connector 24 of one of the pairs of connectors 24 is damaged, or when a single connector 24 of each of the pairs of connectors 24 is damaged, such as that illustrated at FIG. 2.

Still referring to FIG. 2, once these connectors 24 are destroyed, there is a risk that the rails 22 will tilt generally in direction 40 or shift laterally generally in direction 42. Movement of the rails 22 in either of these directions is undesirable as it can lead to subsequent derailments of other trains traveling along the rails 22.

Figure 3:
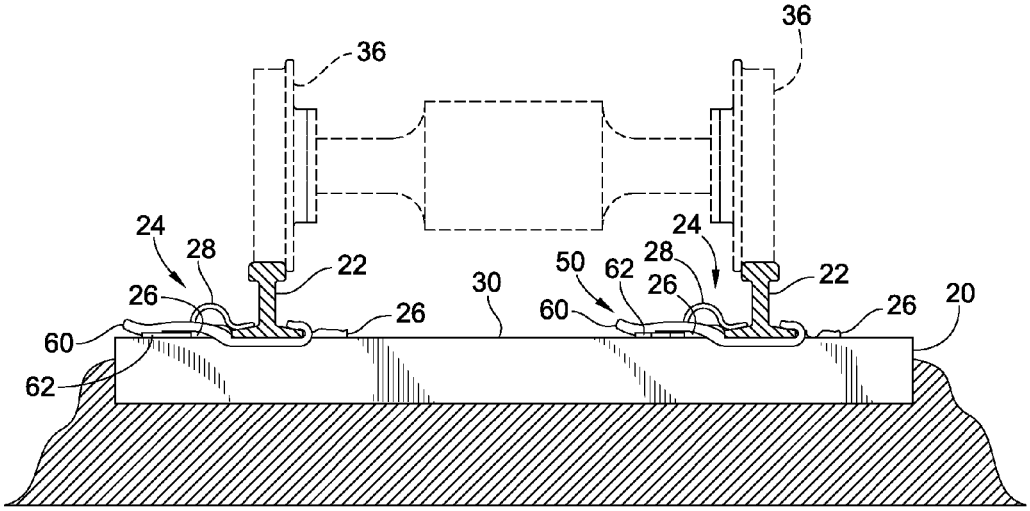
FIG. 3 is a front view of the concrete tie of FIG. 2, with an exemplary first embodiment of a temporary fastener according to the teachings of the present invention affixing the rails to the concrete railroad tie.

Turning now to FIG. 3, to prevent movement along either of directions 40 or 42 (see FIG. 2), an embodiment of a pair of fasteners 50 according to the teachings of the present invention can be employed to maintain each of the rails 22 in a fixed position and ultimately maintain dimensions A and B illustrated in FIG. 1. As will be understood more clearly from the following, employment of these temporary fasteners 50 allows for the continued usage of the rails 22 as indicated by the positioning of the rail wheels 36 thereon in FIG. 3. Accordingly, the temporary fasteners 50 advantageously allow for continued use of the rails 22 despite that two of the connectors 24 have been damaged or otherwise destroyed. Although illustrated in the context of a concrete railroad tie 20, those skilled in the art will appreciate from the following that the fasteners 50 disclosed herein can be equally employed in the context of traditional wooden railroad ties without departure from the teachings of the present invention.

As illustrated in FIG. 3, a temporary fastener 50 is employed at each rail 22. Each temporary fastener 50 includes a pair of clamps 60 and a baseplate 62. As further illustrated in FIG. 3, the baseplates 62 are positioned adjacent to the remaining and undamaged connector 24 adjacent to each rail 22. The clamps 60 contact the baseplate 62, extend under each rail 22 and contact the rail 22 proximate to the area previously contacted by the damaged connectors 24. As a result, a downward pressure is exerted upon the rails 22 similar to that previously exerted by both connectors 24 on either side of the rails 22 as illustrated in FIG. 1. Although illustrated as using a pair of clamps 60, it will be recognized from the following that the teachings of the present invention may be equally employed using a baseplate 62 and a single clamp 60.

Figure 4:
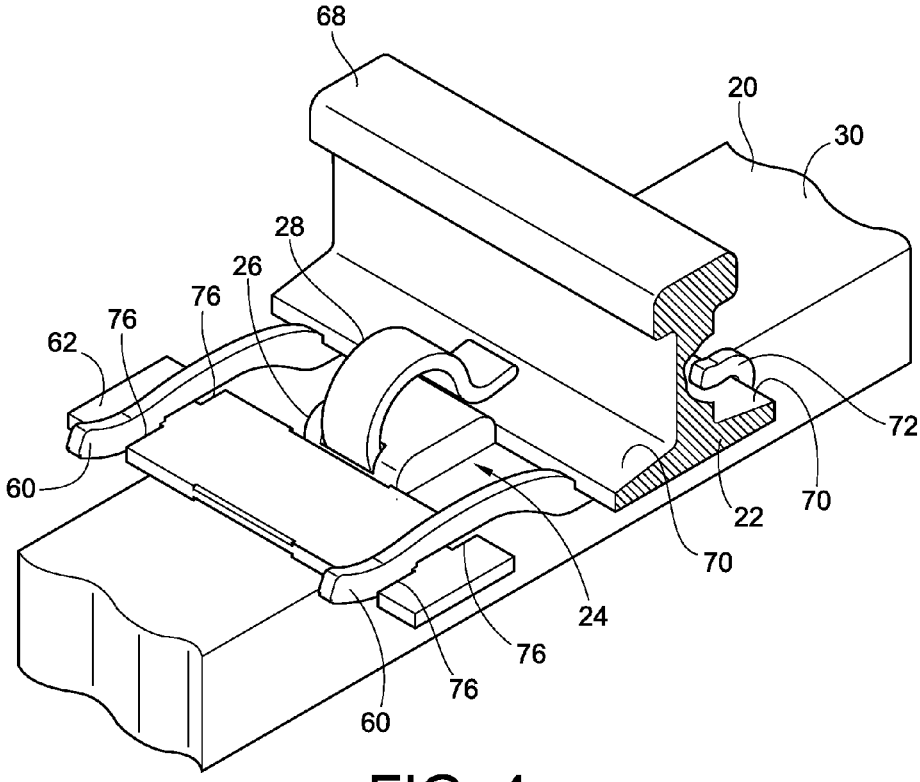
FIG. 4 is a top view of the temporary fastener mounted to the concrete railroad tie.

More specifically, and with reference now to FIG. 4, each rail 22 includes a rail head 68 with a pair of flanges 70 extending from either side of the rail head 68. Typically, the clips 28 contact each of the flanges 70. However, in the event one of the connectors 24 (and thus the associated clip 28) is destroyed, the clamps 60 can be used to contact the corresponding flange 70 as illustrated. Indeed, each of the clamps 60 includes a hook portion 72 for contacting the flange 70. Each of the clamps 60 also includes a handle portion 74 extending away from the hook portion 72. The handle portion 74 couples with the baseplate 62 as illustrated.

The baseplate 62 is positioned adjacent to the remaining fastener and generally underneath a portion of the clip 28 associated therewith. An end of each clamp 60 opposite the hook portions 72 thereof contacts the baseplate 62 and locates within locating slots 76.

Figure 5:
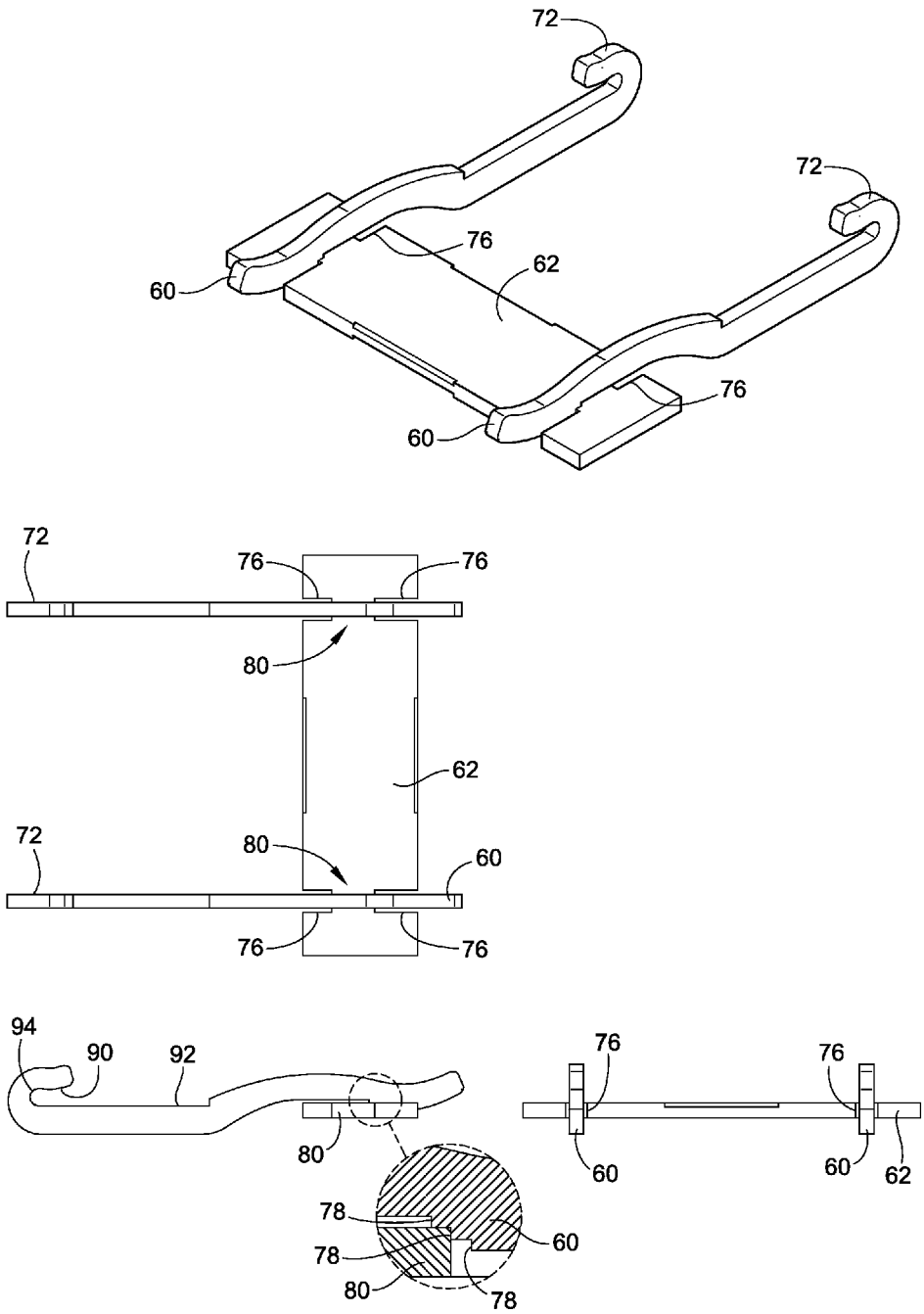
FIG. 5 is a collection of views of the temporary fastener of FIG. 4.

The above introduced location between the clamps 60 and baseplate 62 is better illustrated in FIG. 5. As illustrated in FIG. 5, each clamp 60 also includes a plurality of locating walls or abutments 78, one of which engages a neck portion 80 of the baseplate 62 formed between adjacent locating slots 76 thereof. It will be recognized that such a configuration advantageously prevents the unwanted movement of the clamps 60 relative to the baseplate 62, and defines a plurality of mounting locations of the clamps 60 relative to the baseplate 62 to achieve fine adjustment of the clamps 60 relative to baseplate 62.

Figure 6:
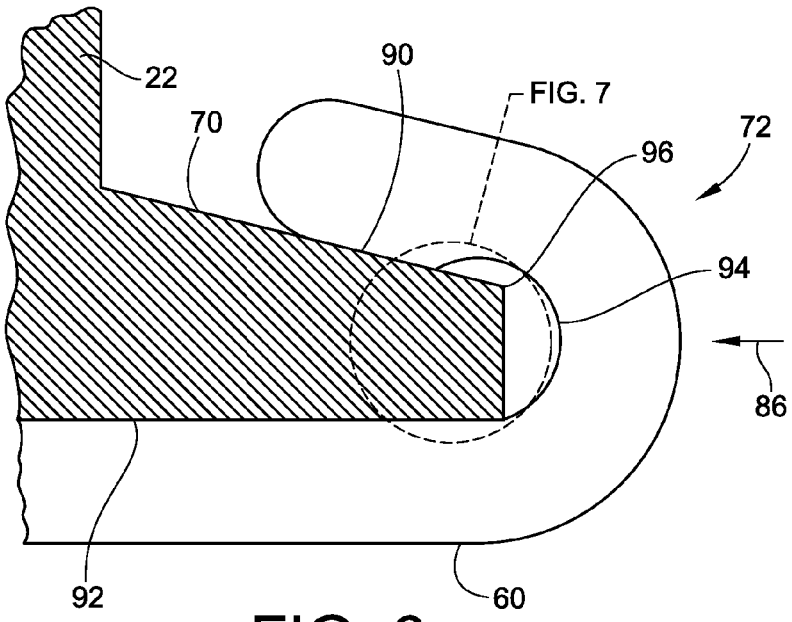
FIG. 6 is a partial view of a hook portion of a clamp of the temporary fastener of FIG. 4 interacting with a portion of a rail.

Turning now to FIG. 6, the clamps 60 are installed by sliding the hook portion 72 along direction 86 until an end or corner 96 of the flange 70 is disposed in a generally circular relief section 94. As will be explained in greater detail below, the hook portion 72 also includes a top abutment surface 90 and, a bottom abutment surface 92, on either side of the relief section 94 that engage opposing sides of the flange 70.

Figure 7:
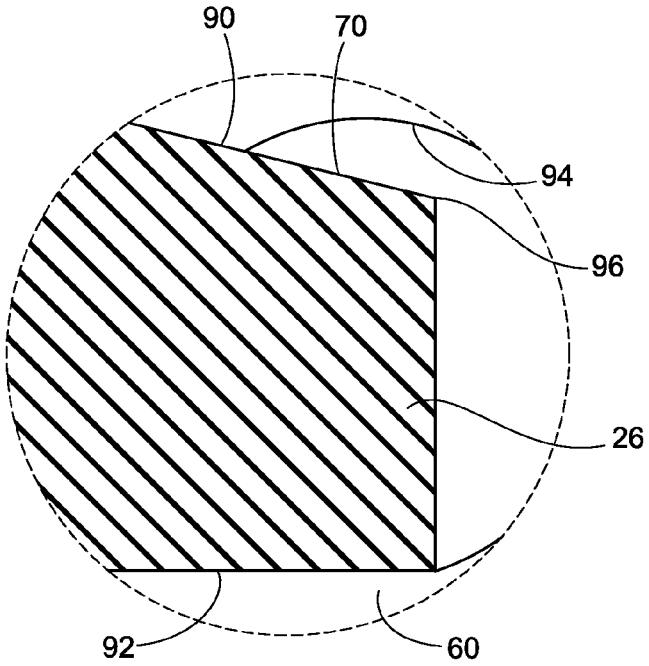
FIG. 7 is a partial view of the hook portion of FIG. 6.

Still referring to FIG. 6, the relief section 94 has a radius and is tangent with the bottom abutment surface 92. However, the top abutment surface 90 is not tangent with the relief section 94. Such a configuration advantageously ensures that the top abutment surface 92 exerts a pressure against an upper surface of the flange portion 70 interior from the end or corner 96 of the flange section 70 of each rail. Such a configuration avoids the undesirable effect of deformation of the corner 96 of each flange portion 70. This arrangement is further illustrated at FIG. 7.

Figure 8:
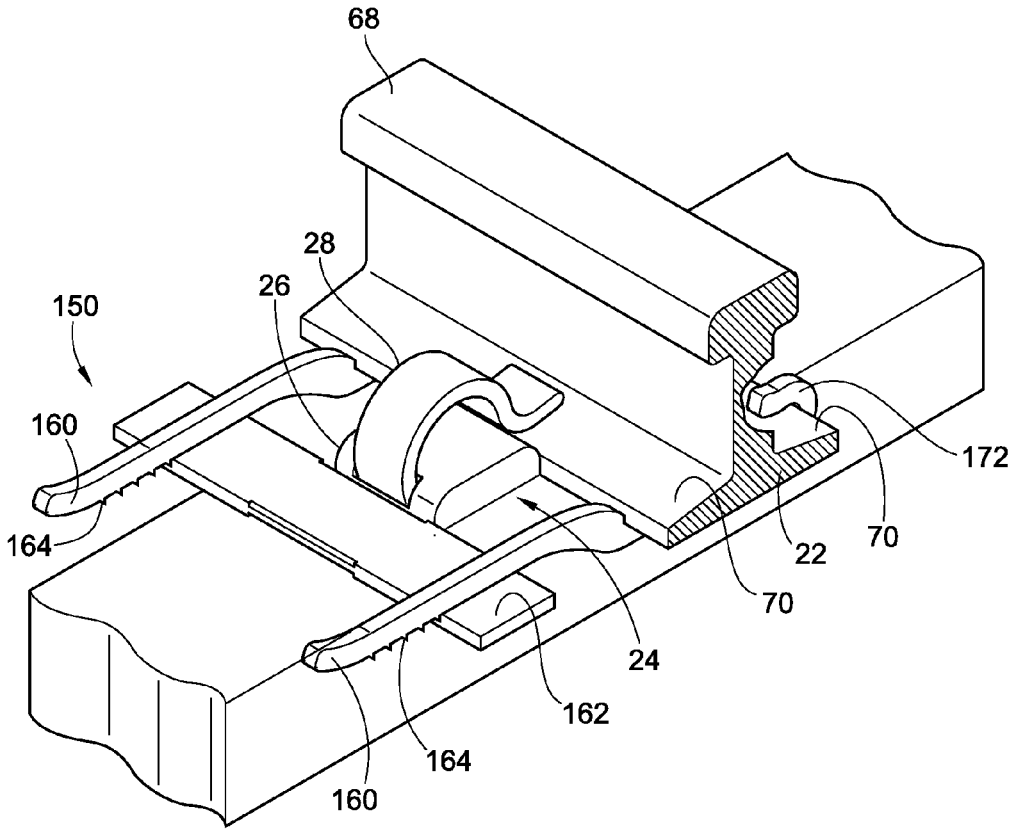
FIG. 8 is a perspective view of a second embodiment of a temporary fastener.

Turning now to FIG. 8, another embodiment of a temporary fastener 150 is illustrated. This embodiment is generally similar to that described above relative to FIGS. 3-7, with the exception that clamp 160 of this embodiment of a temporary fastener 150 includes a plurality of serrations or abutments 164 formed on an underside of the clamps 160. The abutments 164 are used to finely adjust the positioning of the clamps 160 relative to the baseplate 162. Indeed, it is not uncommon for a rail 22 to become off center between connectors 24 on either side of the rail 22. Both connectors 24 associated with the rail 22 of FIG. 8 are shown intact to illustrate this point. However, it will be recognized that the temporary fastener 150 is typically employed when one of the connectors 24 of FIG. 8 has been damaged or destroyed in the particular arrangement of FIG. 8.

In the event that the rail 22 does in fact become off center, and one of the connectors 24 later destroyed as a result of a derailment, the distance from the abutting edge 66 of the remaining connector 24 and the corner 96 of the opposite flange 70 will vary from the distance of a truly centered rail 22. As will be explained in greater detail below, the abutments 164 provide a way to cope with this varying distance by defining a plurality of mounting points for each clamp 160 relative to the baseplate 162. As a result, the overall distance from the hook portion 172 of each clamp 160 to the baseplate 162 can also be varied.

Figure 9:
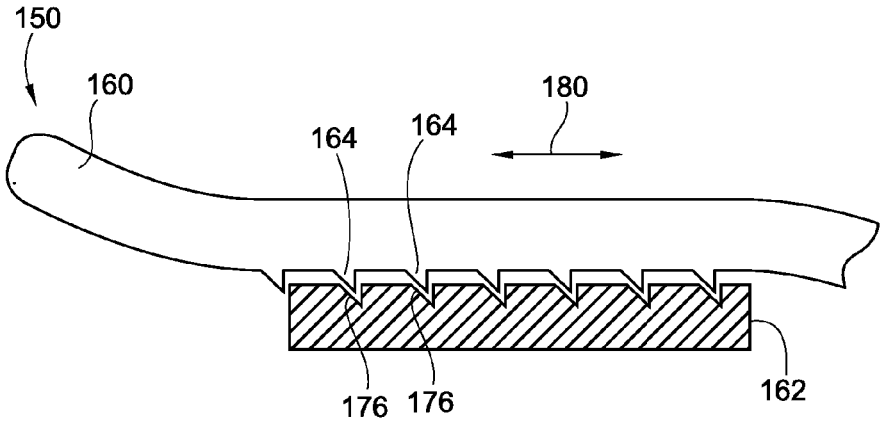
FIG. 9 is a partial view of adjustment teeth and adjustment grooves of the temporary fastener of FIG. 8.

Turning now to FIG. 9, the above described adjustability is shown in greater detail. Indeed, the baseplate 162 includes a plurality of adjustment grooves 176 the spacing of adjacent adjustment grooves 176 is equivalent to the spacing between adjacent abutments 164 of the clamp 160. As a result, the clamp 160 is generally adjustable along direction 180 relative to the baseplate 162. Such a configuration advantageously allows for the clamp 150 to accommodate the varying distance of the rail 22 from the remaining connector 24 (see FIG. 8). It will be recognized that the adjustment grooves 176 are one of many variations of baseplate 162 features that can accommodate the abutments 164, and therefore, the invention is not in any way limited to that shown.

Figure 10:
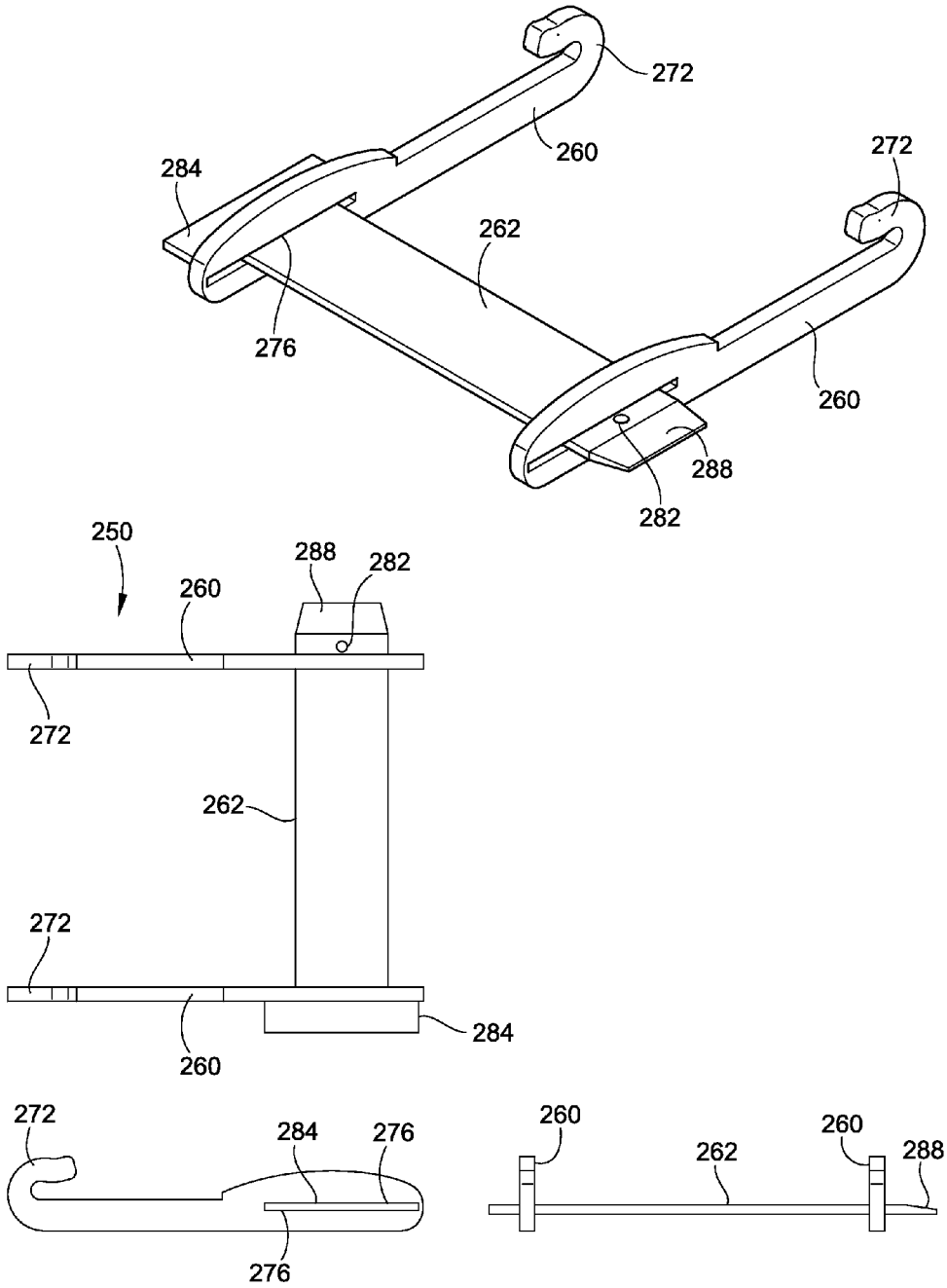
FIG. 10 is a collection of views of a third embodiment of a temporary fastener.

Turning now to FIG. 10, another embodiment of a temporary fastener 250 is illustrated. This embodiment of a temporary fastener 250 is similar to the embodiments described above with the exception that the baseplate 262 is received in slots 276 formed in each of the clamps 260. Such a configuration further ensures the fixed positioning of the clamps 260 relative to the baseplate 262. In this embodiment, the baseplate 262 can also include a pin 282 passing there through preventing the lateral movement of the baseplate 262 laterally through the slots 276. The baseplate 262 also includes an abutment section to also restrict lateral movement of the baseplate 262 laterally through the slots.

The baseplate 262 can also incorporate a blade section 288 to enhance the ease of installation of the baseplate 262 within the slots 276. The blade section 288 is located at an end of the baseplate 262 opposite the abutment section 284. As illustrated, the blade section 288 has a tapered shape.

The portion of the baseplate 262 extending from the abutment section is more narrow than the slots 276. This advantageously allows for fine adjustment of the clamps 260 relative to the baseplate 262 to accommodate off center rails as discussed above. Further, the thickness of the portion of the baseplate 262 extending from the abutment section 284 is thick enough such that the baseplate 262 is tightly wedged within the slots 276 of each of the claims 260.

Having described the various structural attributes of embodiments of the present invention, the following provides the general operation of the same. Referring back to FIG. 4, to install the first embodiment of a temporary fastener 50, the baseplate 62 is first positioned against the top surface 30 of the tie 20. The baseplate 62 is positioned such that it abuts the remaining connector 24 as illustrated. Thereafter, each clamp is passed under the rail 22 until the hook portion 72 of each clamp is proximate to the flange section 70 of the rail 22 opposite the flange 70 that the clip 28 abuts.

With reference now to FIG. 6, once the hook portions 72 are in position, the hook portions are forced along direction 86 until the top and bottom abutment surfaces 90, 92 come into contact with the flange 70 of the rail 22. The hook portions 72 are moved laterally along direction 86 until the corner 96 of the flange 70 is positioned within the relief section 94.

At the same time, the opposite end of the clamp 60 is moved relative to the baseplate 62 until the neck portion 80 of the baseplate 62 is abutted with one of the abutments 78 of the clamp 60 as illustrated in FIG. 5.

Alternatively, and with reference to FIG. 9, in embodiments incorporating the abutments 164 as illustrated at FIG. 8, the clamp 160 is moved along direction 180 to finely adjust the positioning of the clamp 160 relative the baseplate 62 as the hook portion 172 (see FIG. 8) is positioned in accordance with the above. As this movement along direction 180 occurs, the abutments 164 will successfully seat within the adjustment grooves 176 until the proper distance is achieved.

Finally, and with reference to FIG. 10, in embodiments incorporating slots 276 the clamps 260 are positioned prior to positioning the baseplate 262. Once the clamps 260 are in position by placing the hook portions 272 thereof against the flange 70, the baseplate 262 is passed through slots 276 until the abutment section 284 abuts one of the clamps 260. In embodiments incorporating a locking pin 282 as described above, the pin is thereafter inserted into the baseplate 262.

As described herein, the various embodiments of the instant invention advantageously allow an otherwise unserviceable railroad to temporarily remain serviceable until damaged concrete ties can be replaced. Therefore, the invention eliminates lengthy periods of railroad shutdown while heavy equipment is transported to a derailment cite to replace the damaged railroad ties.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A rail fastening system for securing a rail to a railroad tie, the railroad tie including a first connector on a first side of the rail and a second connector on a second side of the rail, the first and second connectors interposing the rail and operable for securing the rail to the railroad tie when each of the first and second connectors are in a serviceable condition, the rail fastening system comprising:

a baseplate configured for abutment with the first connector;

at least one clamp coupled to the baseplate on the first side of the rail and including a hook portion for contacting the rail on the second side of the rail;

wherein the at least one clamp includes a handle portion extending away from the hook portion such that the handle portion is entirely disposed on the first side of the rail when the at least one clamp is coupled to the baseplate; and wherein the handle portion includes a plurality of abutments on an underside thereof for adjustably coupling the at least one clamp to the baseplate.

2. The rail fastening system of claim 1, wherein the at least one clamp includes a first clamp and a second clamp, the first and second clamps coupled to the baseplate at opposite ends of the baseplate such that the first and second connectors are interposed between the first and second clamps.

3. The rail fastening system of claim 1, wherein the hook portion includes a relief section for receipt of a portion of the rail.

4. The rail fastening system of claim 3, wherein the relief section is generally circular, such that an end of a flange section of the rail is out of contact with the hook portion when disposed within the relief section.

5. The rail fastening system of claim 4, wherein the hook portion includes a top and a bottom abutment surface, the top abutment surface arranged to contact an upper surface of the flange section interior of the end of the flange section.

6. The rail fastening system of claim 5, wherein the bottom abutment surface is arranged to contact an underside of the rail.

7. The rail fastening system of claim 1, wherein the baseplate includes at least one slot for receiving the handle portion such that one of the plurality of abutments abuts a neck portion of the baseplate situated in the slot.

8. The rail fastening system of claim 1, wherein the baseplate includes at least one groove for receiving the handle portion such that one of the plurality of abutments abuts the at least one groove.

9. A rail fastening system for securing a rail to a railroad tie, the railroad tie including a first connector on a first side of the rail and a second connector on a second side of the rail, the first and second connectors interposing the rail and operable for securing the rail to the railroad tie when each of the first and second connectors are in a serviceable condition, the rail fastening system comprising:

a baseplate configured for abutment with the first connector;

at least one clamp including a hook portion for receiving a portion of the rail and a handle portion extending away from the hook portion, the at least one clamp having a mounted position in which the at least one clamp is coupled to the baseplate;

wherein the location of the at least one clamp relative to the baseplate in the mounted position is adjustable;

wherein the handle portion includes a plurality of abutments on an underside thereof for adjustably coupling the at least one clamp to the baseplate.

10. The rail fastening system of claim 9, wherein the at least one clamp includes a first clamp and a second clamp, the first and second clamps coupled to the baseplate at opposite ends thereof such that the first and second connectors are interposed between the first and second clamps.

* * * * *